United States Patent [19]

Baker et al.

[11] 4,253,676

[45] Mar. 3, 1981

[54] INFLATABLE PACKER ELEMENT WITH INTEGRAL SUPPORT MEANS

[75] Inventors: Eugene E. Baker; Steven Streich, both of Duncan, Okla.

[73] Assignee: Halliburton Company, Duncan, Okla.

[21] Appl. No.: 48,842

[22] Filed: Jun. 15, 1979

[51] Int. Cl.[3] ..... F16J 15/40; F16J 15/46

[52] U.S. Cl. ..... 277/34.6; 277/230; 166/122; 166/187; 166/315

[58] Field of Search ..... 277/9.5, 30, 31, 34, 277/34.3, 34.6, 229, 230; 166/120–122, 179, 187, 290, 315

[56] References Cited

U.S. PATENT DOCUMENTS

| | | | |
|---|---|---|---|
| 2,643,722 | 6/1953 | Lynes et al. | 166/187 X |
| 2,778,432 | 1/1957 | Allen | 166/187 |
| 3,085,627 | 4/1963 | Sodick | 166/120 |
| 3,085,628 | 4/1963 | Malone | 166/187 |
| 3,160,211 | 12/1964 | Malone | 116/187 |
| 3,401,946 | 9/1968 | Malone | 277/34.6 |
| 3,437,142 | 4/1969 | Conover | 166/187 X |
| 3,529,667 | 9/1970 | Malone | 166/315 |
| 3,542,127 | 11/1970 | Malone | 166/122 |
| 4,003,581 | 1/1977 | Hutchinson | 277/34.6 |
| 4,191,383 | 3/1980 | Baker et al. | 277/230 X |

*Primary Examiner*—Robert S. Ward, Jr.

*Attorney, Agent, or Firm*—John H. Tregoning; James R. Duzan; Lucian W. Beavers

[57] ABSTRACT

The inflatable bladder means of the inflatable packer of the present invention includes an integral support means for bridging an annular space between the packer and a well casing, to increase the ability of the inflatable packer to withstand differential pressures within said annular space. The integral support means includes a plurality of reinforcing layers with each of said layers having a first end securely fastened to an annular anchor shoe means and a free second terminating between the anchor shoe means and a sliding shoe means. The integral support means further includes a second plurality of reinforcing layers which are radially alternated with the reinforcing layers of the first plurality. Each of the reinforcing layers of the second plurality includes a first free end terminating adjacent the anchor shoe means and a second free end terminating between the anchor shoe means and the sliding shoe means. The free second ends of successively radially outwardly located reinforcing layers of said first and second pluralities of reinforcing layers are terminated at points successively axially more distant from said anchor shoe means. A second similarly constructed reinforcing element is provided in the other end of the inflatable bladder means adjacent the sliding shoe means.

15 Claims, 4 Drawing Figures

INFLATABLE PACKER ELEMENT WITH INTEGRAL SUPPORT MEANS

This invention relates generally to an inflatable packer assembly for sealing an annular cavity about a tubular element, and more particularly, but not by way of limitation, to a packer having an integral support means for bridging an annular space between a retrievable tool and a well casing. Although the following disclosure will, by way of example, describe a retrievable packer for installation on a drill string located inside of a well casing, the integral support means of the present invention may also be used on a casing type packer to seal between the well casing and the well bore.

Inflatable packers may be used in a well for a variety of reasons. Particularly, on retrievable inflation packers, they are generally used in conjunction with fracturing, cementing, treating, or testing operations on oil or gas wells.

Retrievable inflation packers generally include first and second annular end shoes, with an inflatable bladder means connected between the end shoes. When the bladder means is inflated, it expands to seal the annular area between the drill string and the well casing. The amount of differential pressure within that annular area, and across the vertical length of the inflatable bladder, which the packer can withstand is generally limited by the extrusion resistance of packer element around the end shoes. That is, the axial forces acting across the inflated bladder, due to a hydrostatic pressure differential above and below the bladder, causes the inflated bladder to roll over the shoe adjacent the low pressure area.

In casing type inflation packers, i.e. that is inflation packers which are permanently located in the casing string to seal between the well casing and the well bore hole, expanding metal fingers may be placed adjacent the ends of the inflatable bladder near the shoes so as to form a permanent reinforcing bridge across the annular space between the well casing and the well bore hole when the bladder means is inflated. Such deformable metal fingers, may not however, generally be used in retrievable inflation packers, because of the need for deflating the inflatable bladder means so as to retrieve the packer from the well. Generally, if expandable metal fingers were used with a retrievable type packer it would be very difficult to retrieve the packer.

There is, therefore, a need for a means for reinforcing the end portions of an inflatable bladder means for use on a retrievable packer.

The present invention provides such a reinforcing means. The inflatable bladder means of the inflatable packer of the present invention includes an integral support means for bridging the annular space between the packer and the casing, to increase the ability of the inflatable packer to withstand differential pressures within said annular space. The integral support means includes a plurality of reinforcing layers with each of said layers having a first end securely fastened to an annular anchor shoe means and a free second terminating between the anchor shoe means and a sliding shoe means. The integral support means further includes a second plurality of reinforcing layers which are radially alternated with the reinforcing layers of the first plurality. Each of the reinforcing layers of the second plurality includes a first free end terminating adjacent the anchor shoe means and a second free end terminating between the anchor shoe means and the sliding shoe means. The free second ends of successively radially outwardly located reinforcing layers of said first and second pluralities of reinforcing layers are terminated at points successively axially more distant from said anchor shoe means. A second similarly constructed reinforcing element is provided in the other end of the inflatable bladder means adjacent the sliding shoe means.

FIGS. 1A–1B comprise a sectional elevation view of the inflatable packer assembly of the present invention.

Figure 1A:
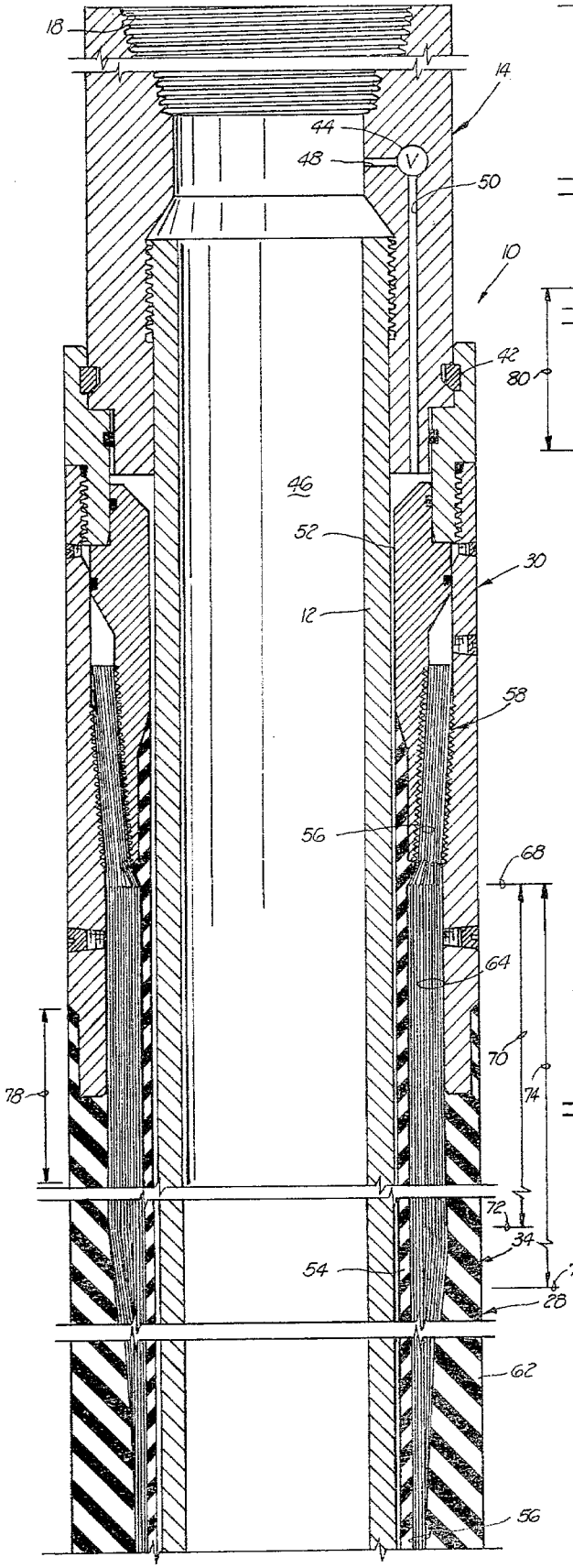
Figure 1B:
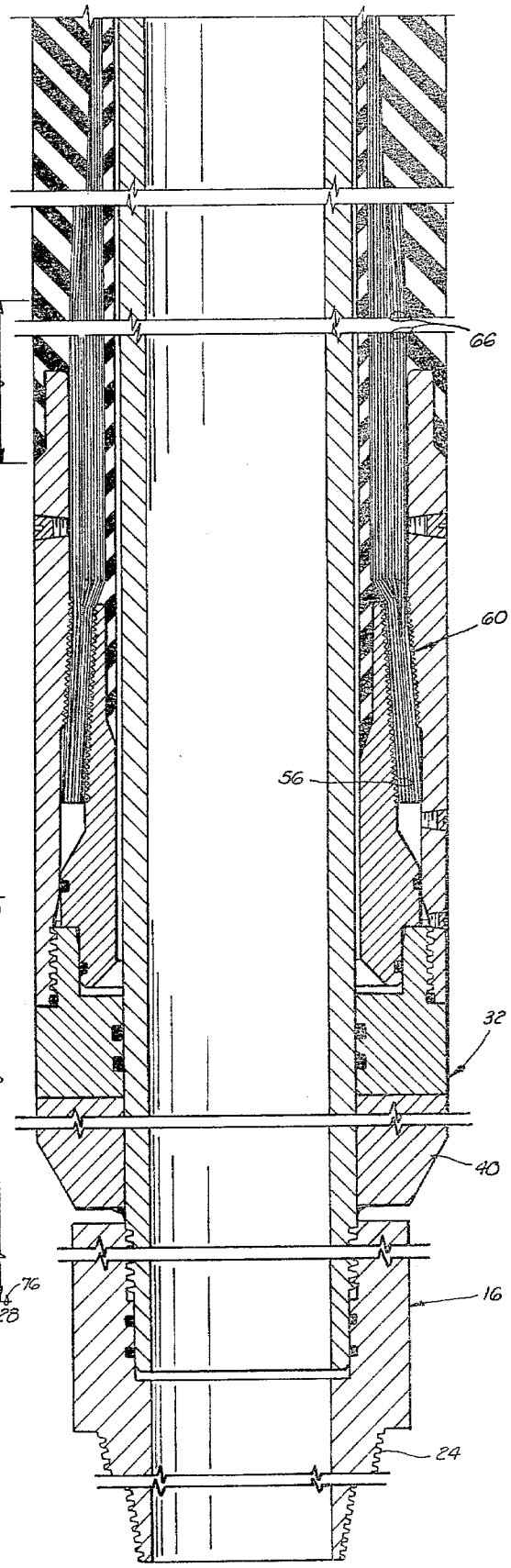

Referring now to the drawings and particularly to FIGS. 1A–1B, the inflatable packer assembly of the present invention is shown and generally designated by the numeral 10.

The inflatable packer assembly 10 includes a cylindrical inner mandrel 12 having upper and lower bodies 14 and 16 connected to its upper and lower ends, respectively.

Figure 3:
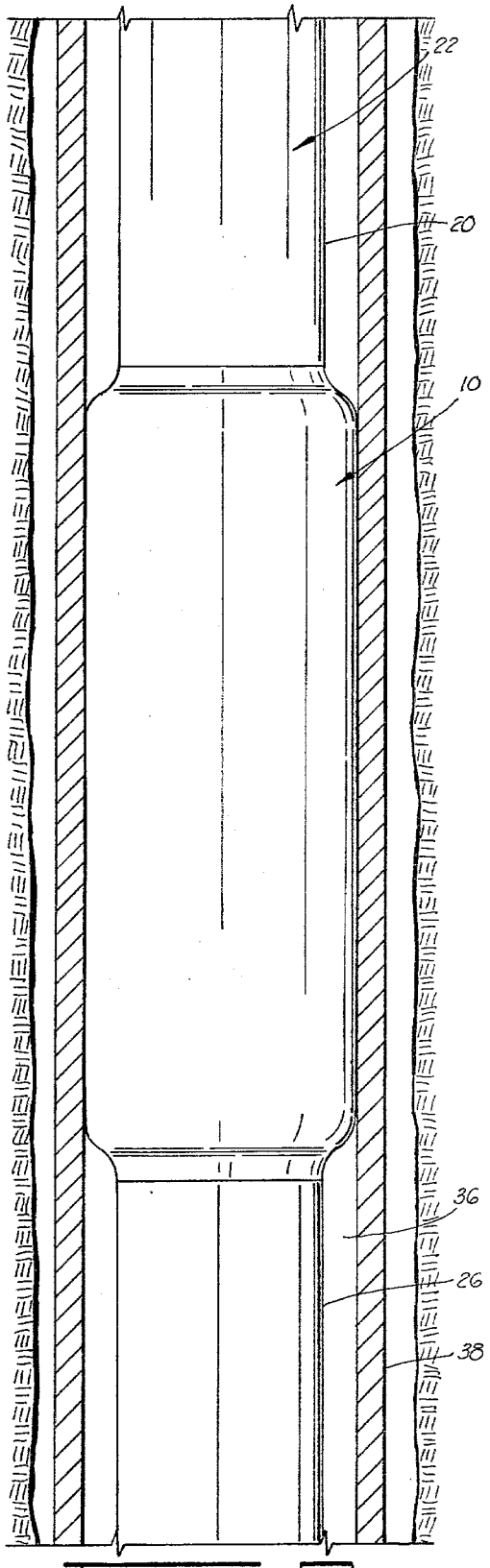
FIG. 3 is schematic sectional elevation view of a retrievable packer in place within a well and in the inflated position.

The upper body 14 includes a threaded bore 18 which provides a means for connecting the inflatable packer assembly 10 to an upper portion 20 of a tubular drill string 22, as seen in FIG. 3. The drill string 22 may generally be referred to as a tubular member. The designation "tubular member" would also apply to casing 38.

The lower body 16 includes an externally threaded portion 24 which provides a means for connecting the inflatable packer 10 to a lower portion 26 of the tubular drill string 22.

Disposed about mandrel 12 between upper and lower bodies 14 and 16 is an annular inflatable packer element generally designated by the numeral 28. The inflatable packer element 28 comprises an upper annular anchor shoe means 30 and a lower annular sliding shoe means 32, with an annular inflatable bladder means 34 connected therebetween and disposed about said mandrel 12 for sealing an annular space 36 between drill string 20 and casing 38. Anchor shoe means 30 and sliding shoe means 32 are axially spaced.

The sliding shoe means 32 slidingly engages the radially outer cylindrical surface of mandrel 12 near the lower body 16. When the bladder means 34 is in the uninflated position as illustrated in FIGS. 1A and 1B the sliding shoe 32 is at its lowest position and freely engages a backup ring 40.

The upper anchor shoe means 30 is fixedly attached to upper body 14 by suitable means such as wedge lock ring 42.

It should be noted that the upper and lower bodies 14 and 16 are illustrated only in a generally schematic form. Particularly the upper body 14 is schematically illustrated as including a valve means 44 for communicating well fluid from an interior 46 of the drill string 20 and casing 12 through inlet port 48 and outlet port 50 so that the well fluid is communicated with the small annular clearance 52 between the outer surface of mandrel 12 and the inner surface of inflatable packer element 28. In a manner well known to those skilled in the art, well fluid may be selectively directed from the interior 46 through port 48, valve 44, port 50 and clearance 52 to the bladder means 34 to inflate the same.

Inflatable bladder means 34 includes a radially inner elastomeric element 54 connected between upper and lower shoes 30 and 32. The inner elastomeric element is surrounded by a reinforcing element 56 which is securely fastened or attached at its upper and lower ends to upper anchor shoe means 30 and lower sliding shoe means 32, respectively.

In the embodiment illustrated in FIGS. 1A–1B each of the anchor shoe means 30 and sliding shoe means 32 includes tapered complementary wedging means 58 and 60, respectively, for tightly gripping the ends of reinforcing element 56.

Inflatable bladder elements with wedging connections and reinforcing elements securely fastened to those wedging elements are shown in U.S. Pat. No. 3,437,142 to Conover, No. 3,160,211 to Malone, No. 3,085,628 to Malone, No. 3,085,627 to Sodich, No. 2,778,432 to Allen, and No. 2,643,722 to Lynes et al.

Bladder means 34 further includes an outer elastomeric covering 62 which surrounds the reinforcing element 56.

The inflatable bladder means 34 further includes upper and lower integral support means 64 and 66.

The reinforcing element 56 and the upper integral support means 64 of the inflatable bladder means 34 are comprised of a plurality of layers of steel tire cord material or other similar reinforcing material.

Reinforcing element 56 is comprised of four layers of reinforcing material all of which extend from within the wedge means 58 of anchor shoe means 30 to within the wedge means 60 of sliding shoe means 32. The four layers of reinforcing material comprising the reinforcing element 56 are laid on alternating 60° bias with the circumference of the inflatable packer assembly 10 for the full length of the packer. Each of those four layers extend into the wedge ring sections 58 and 60 of the anchor shoe means 30 and the sliding shoe means 32, respectively.

The upper integral support means 64 is comprised of eight additional layers of reinforcing material which are placed over and located radially outward of the first four layers which comprise the reinforcing element 56. The first, radially inwardmost, layer of upper integral support means 64 has a first free end located at the line indicated as 68 on FIG. 2, which line 68 is located closely adjacent anchor shoe means 30 at the lower edge of wedge means 58. This first layer of integral support means 64 has a second free end terminating at line 72 which is spaced axially downward a first distance below line 68.

By the term "free end" it is meant that the referenced end is not securely attached to either the upper anchor shoe means 30 or the lower sliding shoe means 32.

The second layer of upper integral support means 64, located radially outward adjacent the first layer just described, extends upward into the first wedge means 58 so as to be securely attached to anchor shoe means 30, and extends axially downward a second distance 74 below the lower edge 68 of wedge means 58, terminating at line 76.

Similarly the third, fifth and seventh successively radially outward layers of upper integral support means 64 have a first free end terminating at line 68 adjacent the bottom edge of upper wedge means 58, and a second free end terminating between anchor shoe means 30 and sliding shoe means 32.

Also similarly, the fourth, sixth, and eighth successively radially outward layers of upper integral support means 64 have their first ends extending into the upper wedge means 58 so as to be securely fastened to the upper anchor shoe 30, and all have second lower free ends terminating between anchor shoe means 30 and sliding shoe means 32.

The general reason for not extending all eight of the reinforcing layers of reinforcing elements 64 and 66 into the tapered wedging connector means 58 and 60 of anchor shoe means 30 and sliding shoe means 32, respectively, is to reduce the wall thickness of the inflatable bladder means 34. The fewer the number of layers which are sandwiched within the wedge means 58 and 60, the smaller the overall wall thickness of the inflatable bladder means 34 may be. Also a tighter joint is achieved at wedge means 58 and 60 when there are fewer layers of reinforcing materials sandwiched within the wedge means.

In an alternative embodiment of the present invention, the eight layers of the upper integral support means 64 may be slightly rearranged so that the first and second radially inwardmost layers of upper integral support means 64 both have first free ends terminating at line 68. Then the third and fourth layers both extend into the wedge means 58. Next the fifth and sixth layers have their first free ends terminating at line 68, and finally the seventh and eighth layers have their first ends extending into wedge means 58 so as to be securely fastened to anchor shoe means 30.

As previously described the first radially inwardmost layer, of upper integral support means 64, extends a first distance 70 below the bottom edge 68 of upper wedge means 58. The second layer of upper integral support means 64 extends a second distance 74 below line 68, the second distance 74 being greater than the first distance 70. In a similar fashion the third, fourth, fifth, sixth, seventh and eighth successively radially outer layers of upper integral support means 64 have their free seconds terminating at points successively axially more distant from the lower edge 68 of upper wedge means 58 of anchor shoe means 30.

A first sheet of teflon or other spacing material (not shown) is laid over the radially inwardmost layer of reinforcing element 56 for the full length of the inflatable bladder means 34. A second layer of teflon or other suitable separating material (not shown) is laid radially inward of the eighth or radially outwardmost layer of the upper and lower integral support means 64 and 66, and extends for substantially the full length of the inflatable bladder means 34, beginning a few inches from each of the anchor shoe means 30 and sliding shoe means 32. The second layer of separating material will cover reinforcing element 56 in the midsection of bladder means 34 between upper and lower integral support means 64 and 66.

The purpose of the two teflon layers outward of and inward of the intermost and outwardmost layers of reinforcing material, respectively, is to prevent the rest of the layers of reinforcing material from being bonded together by the elastomeric material comprising the inner elastomeric element 54 and the outer elastomeric cover 62.

The inner elastomeric element 54 is bonded to the radially inwardmost layer of the reinforcing element 56 for the entire of the inflatable bladder means 34. Element 54 is also bonded to anchor shoe means 30 and sliding shoe means 32.

The radially outer elastomeric covering 62 should be bonded to upper anchor shoe means 30, lower sliding shoe means 32, and to the radially outwardmost layer of upper and lower integral reinforcing means 64 and 66.

The lower integral support means 66 is constructed in a manner similar to the upper integral support means 64.

Figure 2:
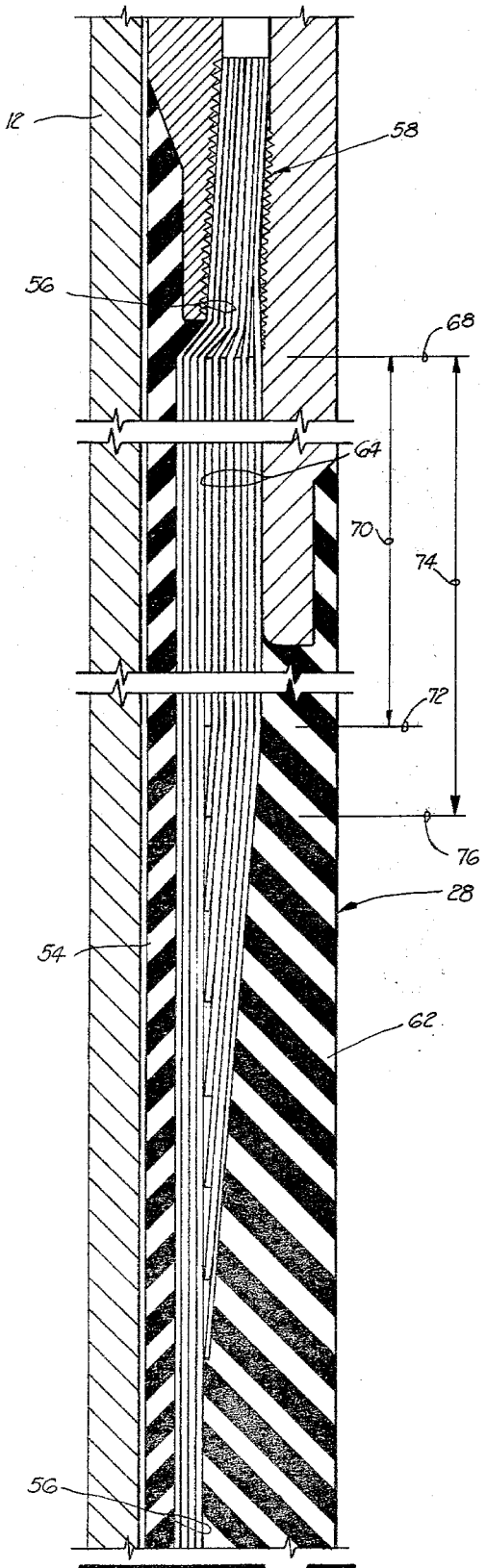
FIG. 2 is an enlarged view of an end portion of the inflatable bladder means illustrating the construction of the integral support means.

In summary, the upper integral support means 64 may be generally described as including a first plurality of reinforcing layers, i.e. the second, fourth, sixth and eighth layers illustrated in FIG. 2, with each of said layers of said first plurality of layers having a first end securely fastened to the annular anchor shoe means 30, by being clamped within wedge means 58, and a second free end terminating between the anchor shoe means 30 and the sliding shoe means 32.

Upper integral support means 74 further includes a second plurality of reinforcing layers, i.e. the first, third, fifth and seventh layers as illustrated in FIG. 2, which are radially alternated with the reinforcing layers of the first plurality. In other words the second layer is located radially outward of the first, the third layer is located radially outward of the second, etc.

Each of the reinforcing layers of the second plurality of reinforcing layers, i.e. the first, third, fifth and seventh layers of upper integral support means 64, includes a first free end terminating at line 68 adjacent the bottom edge of wedge connecting means 68 of anchor shoe means 30, and they each also include a second free end terminating between anchor shoe means 30 and sliding shoe means 32.

The free second ends of successively outwardly located reinforcing layers of said first and second plurality of reinforcing layers are terminated at points successively further away from line 68. That is, the second layer extends downward further than the first layer, the third layer extends downward further than the second, the fourth layer extends downward further than the third layer, etc.

When the inflatable packer assembly 10 is in the inflated position illustrated in FIG. 3, the upper and lower integral support means 64 and 66 are expanded toward casing 38 and provide a means for bridging the annular space 36 about drill string 20 to increase the ability of inflatable packer assembly 10 to withstand differential pressures within annular space 36 axially across packer 10. This construction aids in preventing extrusion of bladder means 34 around anchor shoe means 30 and sliding shoe means 32. It is flexible and therefore may be deflated so that the inflatable packer assembly 10 may be removed from the well.

Thus it is seen that the inflatable packer assembly of the present invention is well adapted to obtain the ends and advantages mentioned as well as those inherent therein. While presently preferred embodiments of the invention have been described for the purpose of this disclosure, numerous changes in the construction and arrangement of parts can be made by those skilled in the art, which changes are encompassed within the spirit of this invention as defined by the appended claims.

What is claimed is:

1. An inflatable packer element, comprising:

a first annular shoe means;

a second annular shoe means axially spaced from said first show means;

an inflatable bladder means connected between said first and second shoe means, and including a reinforcing means; and wherein said reinforcing means includes a reinforcing element having first and second ends securely fastened to said first and second shoe means, respectively, and a plurality of reinforcing layers, each of said reinforcing layers having a first end securely fastened to said first shoe means and a free second end terminating between said first and second shoe means.

2. Apparatus of claim 1, wherein said reinforcing layers of said plurality of reinforcing layers are of varying axial lengths and are arranged so that said free second ends thereof are terminated at axially spaced points.

3. Apparatus of claim 2, wherein said free second ends of successively radially outwardly located reinforcing layers of said plurality of reinforcing layers are terminated at points successively further from said first shoe means.

4. Apparatus of claim 1, wherein said reinforcing means further comprises a second plurality of reinforcing layers, said reinforcing layers of said second plurality alternating in radial location with said reinforcing layers of said first plurality.

5. Apparatus of claim 4, wherein each of said reinforcing layers of said second plurality includes a first free end terminating adjacent said first shoe means and a second free end terminating between said first and second shoe means.

6. Apparatus of claim 5, wherein said reinforcing layers of said first and second pluralities of reinforcing layers are arranged so that said free second ends thereof are terminated at axially spaced points.

7. Apparatus of claim 6, wherein said free second ends of successively radially outwardly located reinforcing layers of said first and second pluralities of reinforcing layers are terminated at points successively further from said first shoe means.

8. An inflatable packer for sealing an annular space about a tubular member to which the inflatable packer is attached, said inflatable packer comprising:

a cylindrical mandrel;

an upper body connected to an upper end of said mandrel and including a means for connecting said inflatable packer to an upper portion of said tubular member;

a lower body connected to a lower end of said mandrel and including a means for connecting said inflatable packer to a lower portion of said tubular member;

an annular anchor shoe means fixedly attached to one of said upper and lower bodies;

an annular sliding shoe means slidingly engaging a radially outer surface of said mandrel between said upper and lower bodies;

an inflatable annular bladder means disposed about said mandrel for sealing said annular space about said tubular member upon inflation of said bladder means, said bladder means including a reinforcing element attached to each of said anchor shoe means and sliding shoe means; and wherein said bladder means includes an integral support means for bridging said annular space about said tubular member to increase the ability of the inflatable packer to withstand differential pressures within said annular space across said inflatable packer, said integral support means including a plurality of reinforcing layers with each of said layers having a first end attached to said annular anchor shoe means and a free second end terminating between said anchor shoe means and said sliding shoe means.

9. Apparatus of claim 8, wherein said reinforcing layers of said plurality of reinforcing layers are of varying axial lengths and are arranged so that said free second ends thereof are terminated at axially spaced points.

10. Apparatus of claim 9, wherein said free second ends of successively radially outwardly located layers of said plurality of reinforcing layers are terminated at points successively axially more distant from said anchor shoe means.

11. Apparatus of claim 8, wherein said integral support means further comprises a second plurality of reinforcing layers, said layers of said second plurality being radially alternated with said reinforcing layers of said first plurality.

12. Apparatus of claim 11, wherein each of said reinforcing layers of said second plurality includes a first free end terminating adjacent said anchor shoe means and a second free end terminating between said anchor shoe means and said sliding shoe means.

13. Apparatus of claim 12, wherein said reinforcing layers of said first and second pluralities of reinforcing layers are arranged so that said free second ends thereof are terminated at axially spaced points.

14. Apparatus of claim 13, wherein said free second ends of successively radially outwardly located reinforcing layers of said first and second pluralities of reinforcing layers are terminated at points successively axially more distant from said anchor shoe means.

15. Apparatus of claim 8, wherein said bladder means further comprises a second integral support means including a plurality of reinforcing layers with said layers of said second integral support means having a first end attached to said annular sliding shoe means and a free second end terminating between said sliding shoe means and said anchor shoe means.

* * * * *

UNITED STATES PATENT AND TRADEMARK OFFICE

CERTIFICATE OF CORRECTION

PATENT NO. : 4,253,676

DATED : Mar. 3, 1981

INVENTOR(S) : Eugene E. Baker & Steven Streich

It is certified that error appears in the above-identified patent and that said Letters Patent are hereby corrected as shown below:

Column 5, line 62, delete [show] and substitute therefor --shoe--.

Signed and Sealed this

*Twelfth* Day of *May 1981*

[SEAL]

*Attest:*

RENE D. TEGTMEYER

*Attesting Officer*

*Acting Commissioner of Patents and Trademarks*